US007673820B2

(12) United States Patent
Ivri et al.

(10) Patent No.: US 7,673,820 B2
(45) Date of Patent: Mar. 9, 2010

(54) SUBMINIATURE THERMOELECTRIC FRAGRANCE DISPENSER

(76) Inventors: Yehuda Ivri, 4 Tasman Sea, Newport Coast, CA (US) 92657-2116; George Fellingham, 184 Westridge Dr., San Jose, CA (US) 95117-1149; Sam Ciuni, 850 Quail Meadows, Irvine, CA (US) 92603-4236

( * ) Notice: Subject to any disclaimer, the term of this patent is extended or adjusted under 35 U.S.C. 154(b) by 10 days.

(21) Appl. No.: 11/938,500

(22) Filed: Nov. 12, 2007

(65) Prior Publication Data

US 2008/0142624 A1 Jun. 19, 2008

Related U.S. Application Data

(60) Provisional application No. 60/875,494, filed on Dec. 18, 2006.

(51) Int. Cl.
*B05B 5/00* (2006.01)

(52) U.S. Cl. ..... 239/690

(58) Field of Classification Search ..... 239/690–708, 239/3

See application file for complete search history.

(56) References Cited

U.S. PATENT DOCUMENTS 4,243,994 A 1/1981 Kobayashi et al.
4,251,824 A 2/1981 Hara et al.
4,337,467 A 6/1982 Yano
4,380,786 A * 4/1983 Kelly ..... 361/228
4,431,137 A * 2/1984 Prewett et al. ..... 239/690
4,765,539 A * 8/1988 Noakes et al. ..... 239/3
6,371,451 B1 4/2002 Choi
6,386,195 B1 * 5/2002 Coffee ..... 128/200.14
2006/0126444 A1 6/2006 Ellner et al.
2007/0138326 A1 6/2007 Hu

FOREIGN PATENT DOCUMENTS

WO WO 2006/059059 A1 6/2006

* cited by examiner

*Primary Examiner*—Daniel L Robinson
(74) *Attorney, Agent, or Firm*—Townsend and Townsend and Crew, LLP

(57) ABSTRACT

A dispenser for dispensing a liquid includes a chamber holding a supply of liquid, an annular conduit substantially filled with liquid from the chamber, and a thermoelectric transducer near one end of the annular conduit. Upon application of electrical current to the thermoelectric transducer, the transducer operates to cause boiling of a quantity of liquid in the annular conduit. Expansion of a resulting bubble forces liquid out the end of the annular conduit. The dispenser may include battery powered electronic control circuit that includes a supercapacitor. The liquid may be dispensed in periodic bursts. In one application, the dispenser is especially suited to automatically and unobtrusively dispense a fragrance, perfume, or other personal care liquid worn by a person. In some applications, the dispenser may be worn on or under an article of clothing, or attached to an article of jewelry.

26 Claims, 14 Drawing Sheets

SUBMINIATURE THERMOELECTRIC FRAGRANCE DISPENSER

CROSS-REFERENCES TO RELATED APPLICATIONS

This application claims the benefit under 35 USC §119(e) of U.S. Patent Application No. 60/875,494, filed on Dec. 18, 2006, and entitled "SUBMINIATURE THERMOELECTRIC FRAGRANCE DISPENSER" and the above-mentioned application is hereby incorporated by reference in its entirety for all purposes.

BACKGROUND OF THE INVENTION

Various fragrances, perfumes, and other personal care products are often worn so that the wearer exudes a pleasant or attractive scent. Fragrances and perfumes are typically mixtures or solutions of various volatile aromatic compounds in solvents or carriers, and may contain other components as well. The aromatic compounds may be naturally occurring, or may be synthetic. A typical fragrance may contain a mixture of compounds so that the exuded scent is complex, and the scent may change with time as compounds of differing volatility disperse at different rates.

Typically, a fragrance dissipates with time, and is reapplied periodically during the day or during a social engagement. The dissipation rate of a fragrance is variable, and is affected by the volatility of the fragrance, the skin characteristics of the wearer, temperature, air movement, and many other factors. The frequency at which a fragrance needs to be reapplied depends on the dissipation rate, and also on the personal taste of the wearer.

Manually reapplying a fragrance may be inconvenient and may cause an unwanted disruption in a social occasion. It would be desirable for a fragrance to be dispensed or reapplied automatically and unobtrusively. Previous fluid dispensing systems have suffered various difficulties, including large size, excessive power consumption, and poor alignment between the size of droplets of fluid dispensed with the needs of a fragrance dispenser.

BRIEF SUMMARY OF THE INVENTION

According to one embodiment, a dispenser for dispensing a liquid includes a chamber holding a supply of liquid to be dispensed and an annular conduit. One end of the annular conduit is submerged in the supply of liquid and a second end extends or protrudes outside of the chamber. Liquid from the supply substantially fills the annular conduit. The dispenser also includes a thermoelectric transducer near the second end of the annular conduit. Upon application of electrical current to the thermoelectric transducer, the thermoelectric transducer operates to cause boiling of a quantity of liquid in the annular conduit. The boiling generates a bubble, and the expansion of the bubble forces liquid out the second end of the annular conduit. In some embodiments, the thermoelectric transducer comprises a resistive electrical wire or ribbon wound around the annular conduit. In some embodiments, the thermoelectric transducer comprises a resistive layer deposited on an outer surface of the annular conduit. In some embodiments, the dispenser further comprises an electronic circuit that controls the supply of energy to the thermoelectric transducer, and a battery supplies energy to operate the electronic circuit and supplies energy to the thermoelectric transducer. In some embodiments, the electronic circuit includes a supercapacitor, and the electronic circuit operates to periodically charge the supercapacitor using energy from the battery and discharge the supercapacitor through the thermoelectric transducer, supplying a pulse of energy to the transducer and dispensing a quantity of liquid. The supercapacitor may have an energy density of 0.5 to 10 watt hour/kg. In some embodiments, the dispenser comprises an environmental sensor that is an accelerometer, a temperature sensor, or a light sensor, and the environmental sensor supplies a signal to the electronic circuit, which adjusts the operation of the dispenser in reaction to the signal. In some embodiments, the environmental sensor is an accelerometer, and the electronic circuit reduces power consumption of the dispenser when the signal from the accelerometer indicates that the dispenser has not been moved for a predetermined period of time. In some embodiments, the electronic circuit controls the dispenser to dispense liquid in periodic pulses, and the period between the pulses is adjustable by a user of the dispenser. In some embodiments, the dispenser comprises a venting port that admits air to the chamber as liquid is dispensed, and the port is sealed by a membrane that is permeable to air but impermeable to volatile solvents. In some embodiments, the dispenser comprises a venting port that admits air to the chamber, and the venting port comprises a helical channel through which the air is admitted. In some embodiments, the dispenser comprises, near the second end of the annular conduit, a normally-closed valve configured to prevent passage of the liquid from the annular conduit when the thermoelectric transducer is idle. In some embodiments, the liquid from the supply is drawn into the annular conduit by capillary action. In some embodiments, the liquid is a fragrance or other personal care liquid. In some embodiments, the dispenser comprises means for attaching the dispenser to an article of clothing or jewelry, so that the dispenser is wearable. In some embodiments, the dispenser comprises one or more additional annular conduits and supplies of liquid to be dispensed, and the supplies of liquid are dispensed independently of each other under control of an electronic circuit. In some embodiments, the liquid is dispensed in a spray of droplets upon each actuation, and each actuation sprays at least one microliter of liquid. In some embodiments, the thermal conductivity of the annular conduit is 0.5 to 2.0 watt/M K.

In accordance with another embodiment, a dispenser for dispensing a liquid comprises a disposable module, a reusable module, and an interface between the two modules. The disposable module comprises a chamber containing a supply of liquid to be dispensed, a coin cell battery, an annular conduit having a first end submerged in the supply of liquid and a second end protruding from the chamber, and a thermoelectric transducer proximate the second end of the annular conduit and configured to cause boiling of an amount of liquid in the annular conduit upon the application of electrical current to the thermoelectric transducer. The boiling forces droplets of liquid out the second end of the annular conduit. The reusable module comprises an electronic control circuit that controls operation of the dispenser. The interface between the disposable module and the reusable module attaches the two modules mechanically, makes an electrical connection between the coin cell battery and the electronic control circuit, and makes an electrical connection between the electronic control circuit and the thermoelectric transducer. In some embodiments, the dispenser is wearable. In some embodiments, the liquid is a fragrance. In some embodiments, the electronic control signal comprises a supercapacitor, and the electronic control circuit operates to periodically charge the supercapacitor from the battery and discharge the supercapacitor through the thermoelectric transducer, thereby supplying a pulse of energy to the thermoelectric transducer and dispensing a quantity of liquid. In some embodiments, the dispenser further comprises a user control having an off position and at least one on position, and an opening in the second end of the annular conduit through which liquid is dispensed, and when the user control is in the off position, the user control covers the opening.

According to another embodiment, a method of dispensing a liquid comprises storing a quantity of the liquid in a chamber and filling an annular conduit with liquid from the chamber. An end of the annular conduit protrudes from the chamber. Under the control of an electronic circuit powered by a battery, a pulse of electric current is periodically provided to a thermoelectric transducer proximate the end of the annular conduit. The pulse of electric current causes the thermoelectric transducer to heat, thereby boiling quantity of liquid in the annular conduit. The boiling forces droplets of the liquid from the end of the annular conduit. In some embodiments, the method further comprises generating each pulse of electric current by relatively slowly charging a supercapacitor from the battery and relatively rapidly discharging the supercapacitor through the thermoelectric transducer. In some embodiments the method further comprises pulse width modulating each pulse of electric current so that the rate of heat transfer to the liquid in the annular conduit is controlled in relation to the charge level of the supercapacitor. In some embodiments, the liquid is a fragrance, and the method further comprises wearing a dispenser comprising the chamber, annular conduit, electronic circuit, battery, and thermoelectric transducer. In some embodiments, filling the annular conduit with liquid from the chamber comprises drawing liquid from the chamber into the annular conduit by capillary action.

According to another embodiment, a dispensing system for dispensing a liquid comprises an annular conduit drawing liquid from a supply of liquid by capillary action, a thermoelectric transducer proximate an end of the annular conduit, a battery, a supercapacitor, and an electronic circuit configured to periodically charge the supercapacitor using energy from the battery and discharge the supercapacitor through the thermoelectric transducer. The discharge through the thermoelectric transducer generates heat that causes boiling of a quantity of liquid in the annular conduit, and the boiling forces liquid out the end of the annular conduit.

DETAILED DESCRIPTION OF THE INVENTION

The present invention relates to systems and methods for dispensing a liquid. In some embodiments the liquid is a fragrance, but it will be understood that embodiments of the invention may be used to dispense other personal care liquids such as deodorants, lotions, insect repellents, and the like. For the purposes of this disclosure, a fragrance or perfume is a mixture or solution containing one or more aromatic compounds and worn by a person for cosmetic reasons. As used in this disclosure, the terms fragrance and perfume include any liquid containing aromatic compounds in any concentration, and encompasses perfumes, perfume extract, eau de parfum, eau de toilette, eau de cologne, and other liquids formulated for particular odors or aromas.

Embodiments of the invention provide for the automatic, unobtrusive dispensing of a fragrance by a small, battery-powered device worn on or under a person's clothing. In some embodiments, the dispenser dispenses bursts of liquid periodically, and the time interval between bursts may be adjusted by the user of the dispenser. In this way, the effect of a fragrance may be automatically maintained throughout the day or throughout a long social engagement without the need to manually reapply the fragrance to the wearer's skin or clothing. In some embodiments, the dispenser is formed of two portions—a disposable portion and a reusable portion. The disposable portion contains the liquid to be dispensed, and can be economically replaced when a new supply of liquid is needed.

Figure 1:
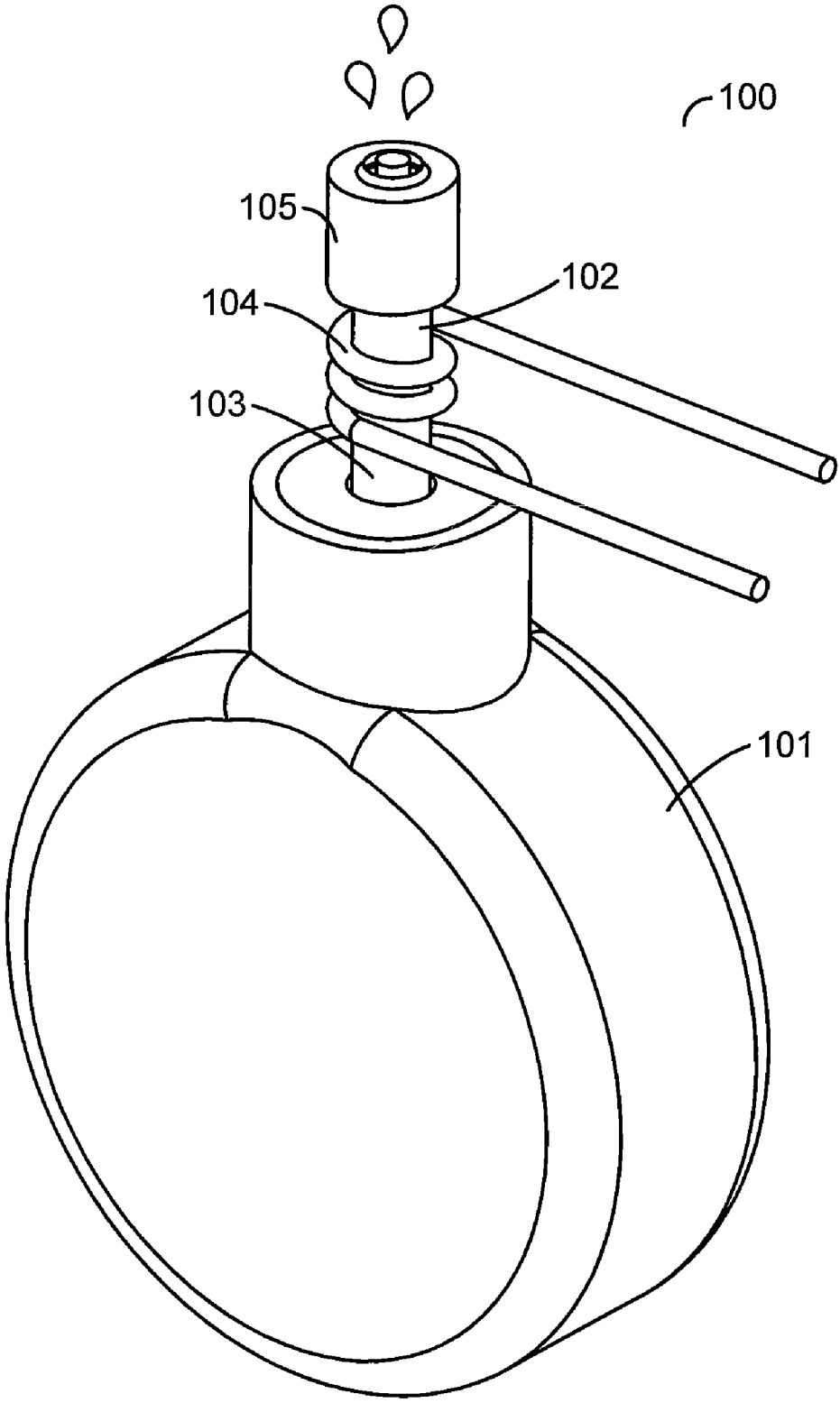
FIG. 1 is a perspective view of a portion of a dispenser, in accordance with an example embodiment of the invention.
Figure 2:
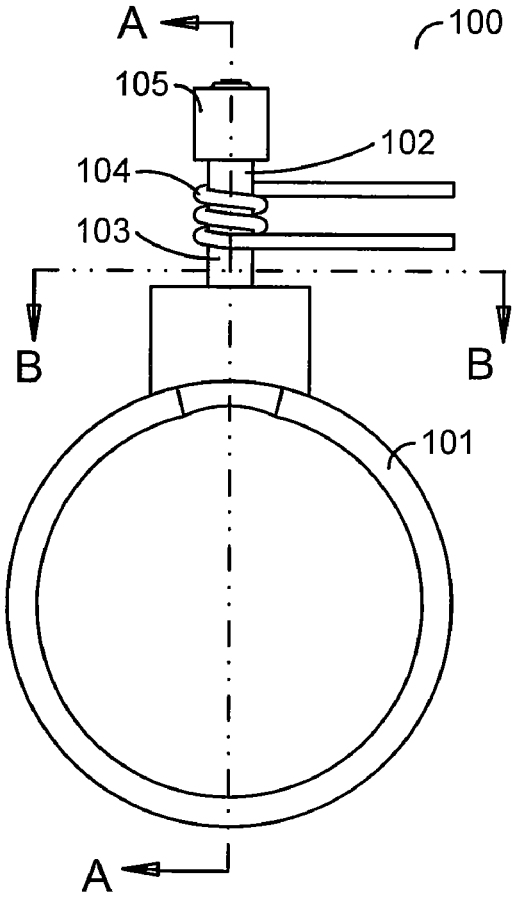
FIG. 2 is a frontal view of the dispenser of FIG. 1.
Figure 3:
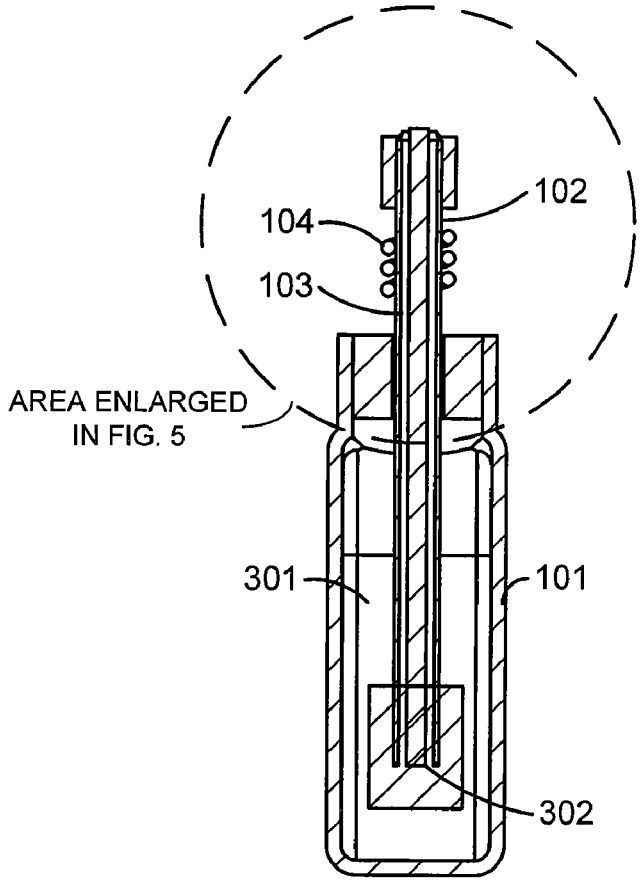
FIG. 3 is a sectional view of the dispenser of FIG. 2, taken through section A-A.
Figure 4:
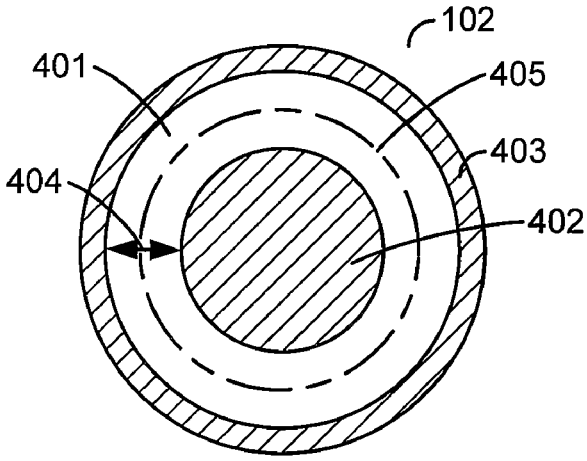
FIG. 4 is a sectional view of the dispenser of FIG. 2, taken through section B-B.
Figure 5:
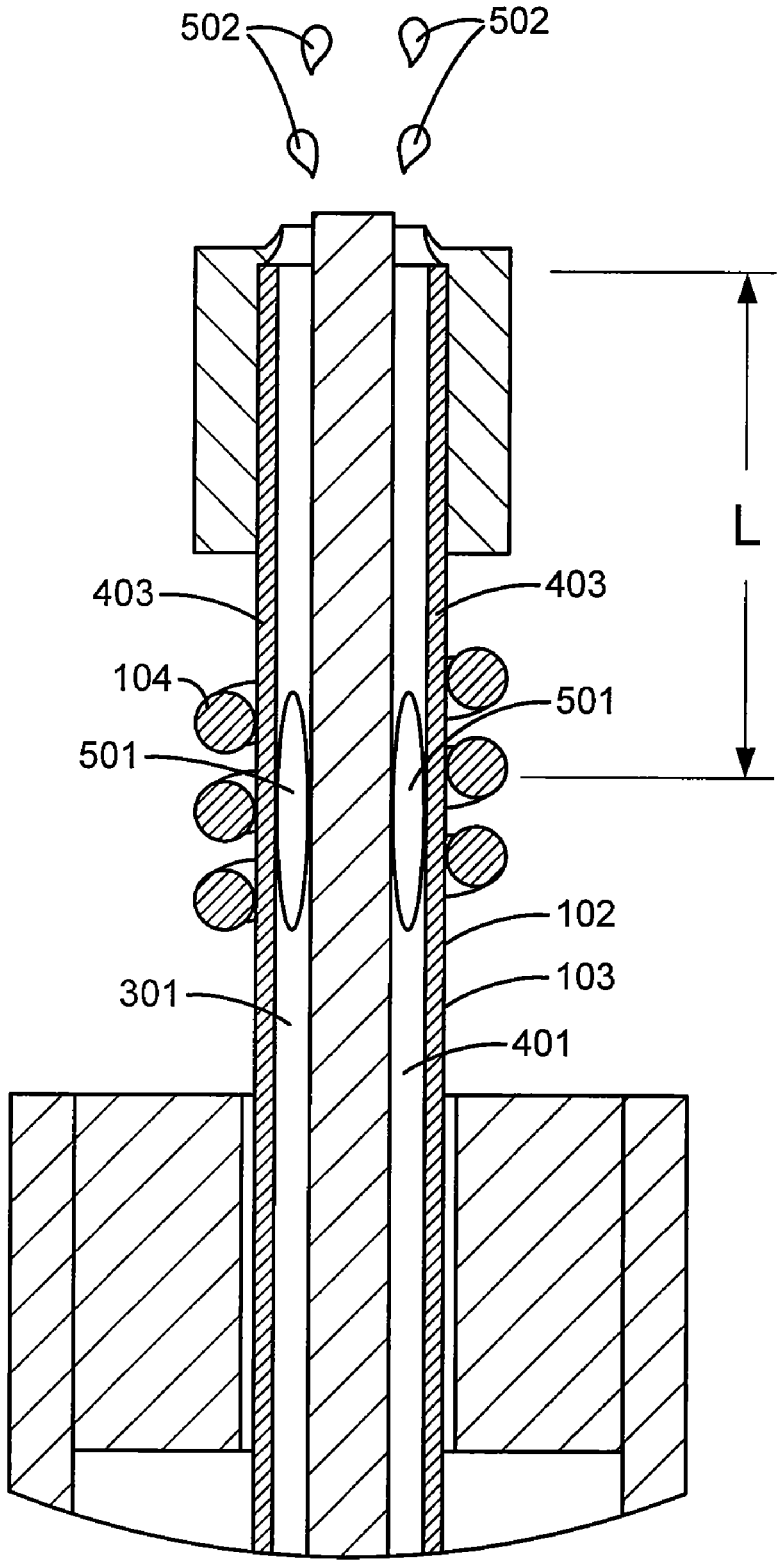
FIG. 5 is an enlarged detail view of a portion of FIG. 3.

FIGS. 1 and 2 shows a perspective view and a frontal view respectively of a dispenser 100 in accordance with an example embodiment of the invention. FIG. 3 shows a sectional view of dispenser 100, taken along section A-A shown in FIG. 2. FIG. 4 is a sectional view of dispenser 100, taken through section B-B shown in FIG. 2. FIG. 5 is an enlarged detail of the area marked "C" in FIG. 3. In the attached figures, the first digit or digits of a reference number indicate the number of the figure in association with which an element is first referred to, and each element is given the same reference number in each figure in which the element appears.

Referring to FIGS. 1-5, dispenser 100 comprises a housing defining a chamber 101 that holds a supply of liquid 301 to be dispensed. An annular conduit 102 has a first end 302, which is submerged in the supply of liquid 301, and a second end 103, which extends or protrudes outside of chamber 101. In some embodiments, annular conduit 102 is appropriately sized to draw liquid 301 from the supply in chamber 101 to second end 103 by capillary action. The capillary pressure overcomes gravity and causes liquid 301 to fill conduit 102. As is best seen in FIG. 4, capillary passage 401 has an annular shape formed between a core member 402 and a thin outer wall 403. The gap size 404 of annular passage 401 is selected according to the desired capillarity based on the liquid properties of the fragrance in use. The mean diameter 405 is selected based on the desired dispensing volume.

In this example embodiment, a resistive electrical wire 104 is wound around annular conduit 102 near second end 103. Resistive wire 104 is one example of a thermoelectric transducer proximate second end 103, and converts electrical energy into thermal energy when electrical current is applied to it. In the case of resistive wire 104, the mechanism for generating heat is ohmic heating, sometimes called Joule or resistive heating. As is best seen in FIG. 5, heat from resistive wire 104 passes through outer wall 403 of conduit 102, and causes near-instantaneous boiling of liquid 301 in conduit 102. The boiling may be nucleus boiling. Nucleus boiling refers to a rapid boiling process that changes the state of a liquid to a gas exclusively at a selected region while the liquid remains in liquid form in other nearby regions. As some of liquid 301 is vaporized, one or more bubbles 501 form in the channel 401 of conduit 102.

Expansion of the one or more bubbles 501 forces a quantity of liquid 301 out of second end 103 of conduit 102. Preferably, liquid 301 emerges in the form of particles or droplets 502. Thermoelectric transducer (resistive wire) 104 is placed nominally a distance L from second end 103 of conduit 102. The amount of liquid dispensed is proportional to the volume enclosed within the length L of annular conduit 102. In a preferred embodiment configured to dispense a fragrance, length L is from 3 to 10 millimeters.

Preferably, electrical current is applied to the thermoelectric transducer in intermittent pulses so that intermittent bursts of fragrance are dispensed. The frequency of dispensing may be selected so that a preferred aromatic strength is maintained in the vicinity of dispenser 100. As will be explained in more detail later, a dispenser according to an embodiment of the invention may be worn on or under a person's clothing, or as a piece of jewelry, so that a fragrance level is automatically and unobtrusively maintained without the user having to reapply a fragrance manually.

In some embodiments, a valve 105 is placed at second end 103 of conduit 102, in order to prevent excessive evaporation or spillage of liquid 301. Valve 105 is normally closed, and is preferably forced open by the dispensed liquid as it is forced out of conduit 102 by bubbles 501.

In one example embodiment, core member 402 and outer wall 403 of conduit 102 are made of fused glass silica, although other materials may be used, including metallic and ceramic materials. Glass silica advantageously has a low thermal conductivity, about 1.2 W/m K, has excellent chemical compatibility with fragrance oils, and is optically transparent. Other example materials with low thermal conductivity (less than 4 W/m K) that may be used include borosilicate, Pyrex, quartz, and silicon. In a preferred embodiment configured to dispense fragrance, the thin outer wall 403 has an outside diameter of about 1.5 millimeters and an inside diameter of about 1.2 millimeters, and the core member 402 has a diameter of about 1.0 millimeters, so that the size of gap 404 is from 0.05 to 0.15 millimeters. Other sizes may be used. For example, in a dispenser configured to dispense body-care lotions or hair spray, mean diameter 405 may be, for example, 12 millimeters.

In some embodiments, resistive wire 104 is made of a metal alloy that has a relatively high electrical resistivity. In this way, electrical energy is efficiently converted to heat energy. In one example embodiment, resistive wire 104 is made of a chrome-nickel alloy containing about 80% nickel and about 20% chrome. This alloy is commercially known as Nichrome. In one example embodiment, resistive wire 104 has a diameter of about 0.1 millimeters, and its total resistance is about 2 ohms. Other materials having other resistivities may be used. Preferably the resistivity of the material of resistive wire 104 is between about $200\times10^8$ and $1000\times10^8$ Ωm.

Figure 7:
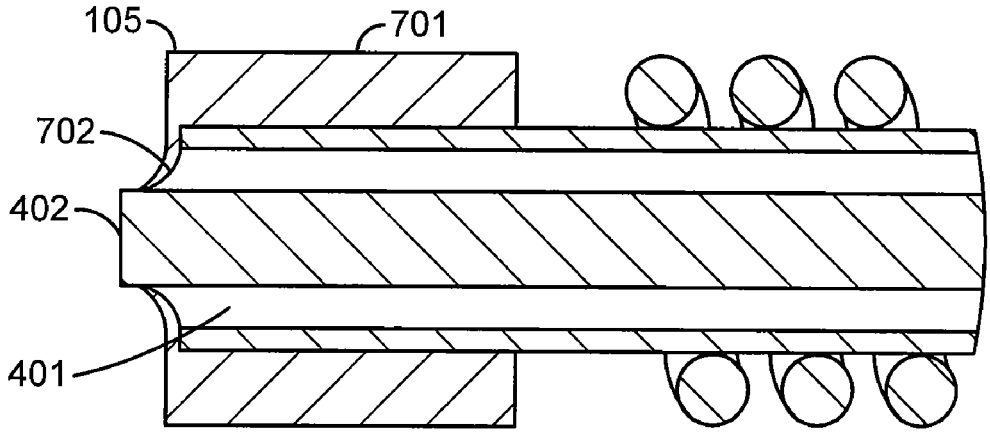
FIG. 7 is a cross sectional view of a normally-closed dispensing valve, in accordance with an example embodiment of the invention.
Figure 8:
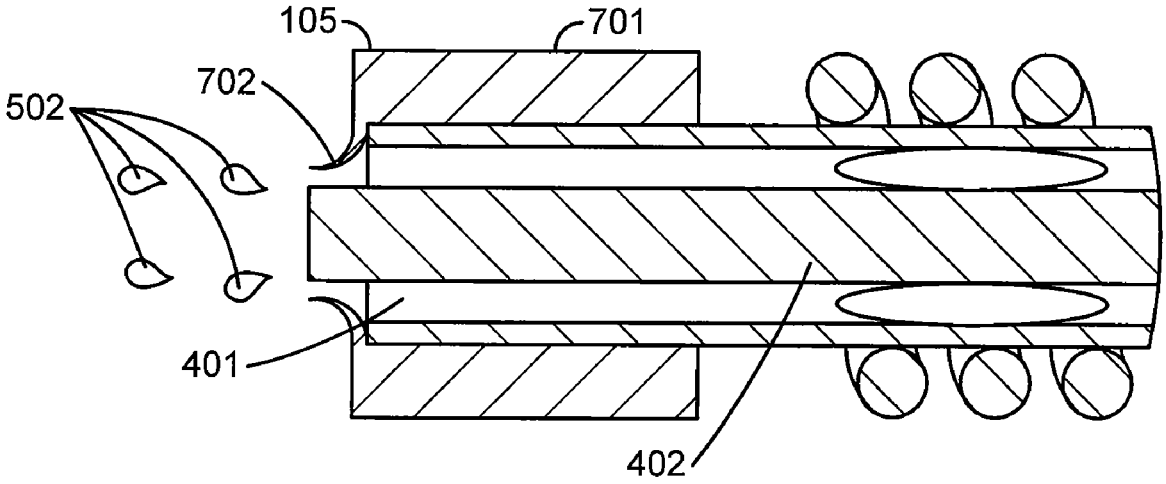
FIG. 8 is a cross sectional view of the valve of FIG. 7, in an open state.

FIGS. 7 and 8 show more detail about the operation of example valve 105. In one example embodiment, valve 105 comprises an outer tubular section 701 and an elastic lip 702 that seals against the outer surface core member 402 of annular conduit 102 when no liquid is being dispensed. In this way, capillary passage 401 is sealed from the outside environment. Valve 105 in this closed position is shown in FIG. 7. As is shown in FIG. 8, when liquid is being dispensed, lip 701 is forced away from the outer surface by dispensed liquid, allowing liquid particles 502 to eject from dispenser 100. Example valve 105 is made of an elastic material that is chemically compatible with fragrance solutions, for example fluorocarbon or fluorosilicon. Other materials may be used as well.

Figure 6A:
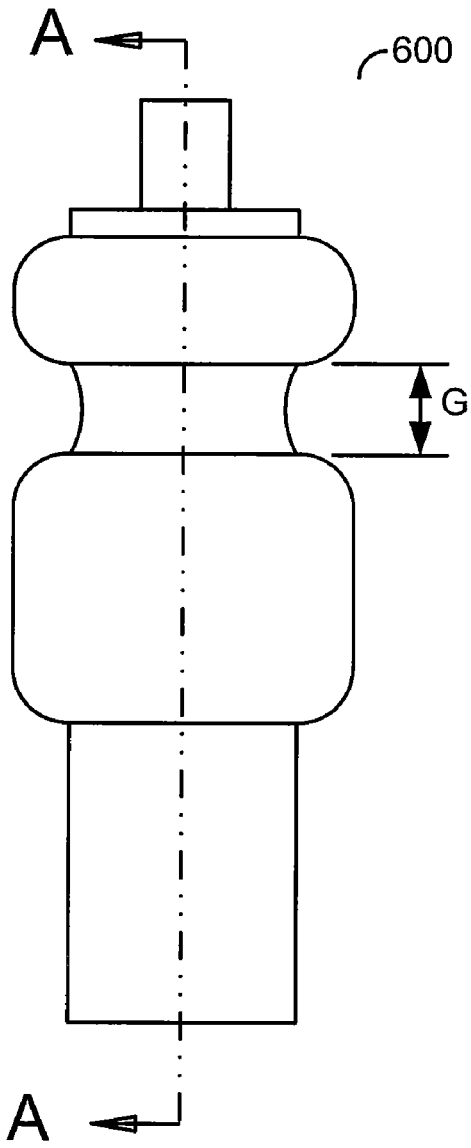
FIG. 6A is an illustration of an alternative thermoelectric transducer, in accordance with an example embodiment of the invention.
Figure 6B:
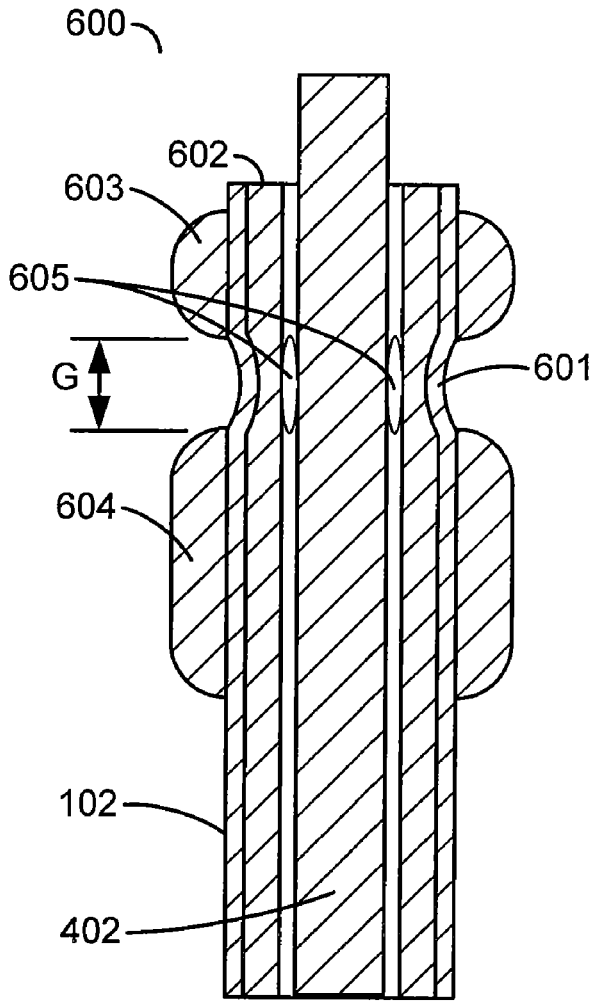
FIG. 6B is a cross sectional view of the thermoelectric transducer of FIG. 6A, taken through section A-A.

FIGS. 6A and 6B show a thermoelectric transducer 600 in accordance with another example embodiment of the invention. FIG. 6A shows an external view of transducer 600, and FIG. 6B shows a cross sectional view taken along section A-A shown in FIG. 6A. Example transducer 600 comprises a thin chrome layer 601 that is deposited directly on thin outer wall 602 of conduit 102, forming a layer of relatively high electrical resistance. A second layer a third layer are deposited selectively over the first chrome layer 601 and define two terminals 603 and 604 through which electrical current is conducted to chrome layer 601. The gap G between the terminals 603 and 604 defines the length of chrome resistance layer 601. In one example embodiment, the thickness of chrome layer 601 is about 1000 Å (0.1 micron) and the gap G is about 1.0 millimeter, resulting in a total resistance between the terminals of about 2 ohm.

Chrome layer 601 may be deposited by a sputtering process in the presence of argon or carbon dioxide. This process produces a resistance of about 10 ohm/square area (regardless of the unit length). Terminals 603 and 604 may be made by electroplating gold or nickel over the first chrome layer 601. The objective of this layer is to reduce the electrical resistance at the terminals 603 and 604, so that heat energy is developed almost exclusively at the chrome layer 601 in the gap area G and not on the terminals 603 and 604. The heat in the gap area G causes one or more bubbles 605 to form. Gold is deposited by means of electroplating. Other metals that may be plated over the chrome layer include silver, nickel, palladium, platinum, tantalum and copper or any element that can be electroplated or otherwise deposited.

Advantageously, the wall thickness of outer wall 602 in the gap region G is relatively thin in comparison to the wall thickness in other regions of the outer wall. The relatively thin region allows faster conduction of heat energy to the liquid.

The thickness may be reduced along the entire circumference of the outer wall 602 or along part of the circumference of the tubular member such that the mechanical strength of tubular member is minimally affected.

Figure 9:
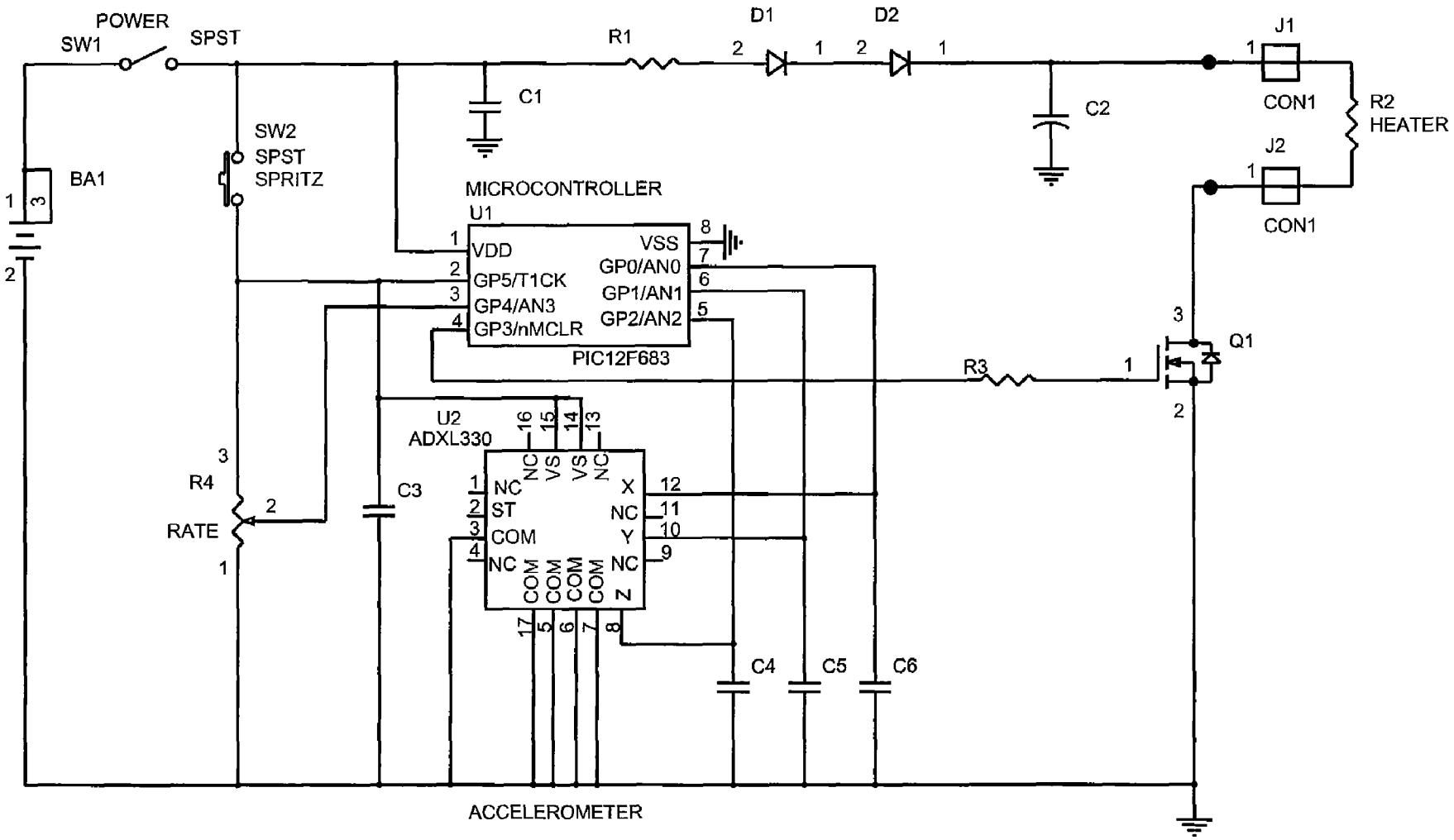
FIG. 9 shows a schematic diagram of an electronic circuit for controlling a dispenser, in accordance with an example embodiment of the invention.

FIG. 9 shows a schematic diagram of an electronic circuit for controlling a dispenser, in accordance with an example embodiment of the invention. The example circuit of FIG. 9 provides a means to produce intermittent short pulses of high power from a low power miniature battery. Preferably, battery BA1 is a coin cell that has a volume of 0.2 to 2 cubic centimeters, and has a cylindrical coin configuration having a diametric dimension larger than the height. This category of battery cells may operate using any of several chemical systems, including lithium, manganese dioxide, silver oxide, alkaline, zinc manganese dioxide and others.

The thermoelectric transducer of the present invention may require a power of about 1-10 watts. However the power available from a miniature coin cell battery is typically about 0.030 watts—several orders of magnitude smaller than the transducer requirement. The example circuit of FIG. 9 performs a two-step process to produce the power requirement. The first step is using the battery to charge a supercapacitor at a relatively slow rate and the second step is discharging the supercapacitor relatively rapidly to the thermoelectric transducer. The circuit may charge the supercapacitor over a period of several minutes or longer. The discharge through the thermoelectric transducer may be nearly instantaneous, taking place in the span of a few milliseconds or less.

Referring still to FIG. 9, battery BA1 may be, for example a model CR2012 battery available from Energizer Holdings, Inc., of St Louis, Mo., USA. The CR2012 battery has a maximum recommended current drain of 0.1 ampere. The circuit of FIG. 9 uses energy from battery BA1 to slowly charge a supercapacitor C2 without exceeding the recommended current drain provided by the battery manufacturer. Supercapacitor C2 may be, for example, an electric double layer super-capacitor model GW1 manufactured by CAP-XX Ltd., of Lane Cove Australia. The model GW1 supercapacitor is packaged in a flat form and has a thickness of about 1 mm and an energy density of 2 watt-hour/kg. This size, weight and energy density configuration is particularly suitable for the subminiature dispensing apparatus of present invention. The GW1 super-capacitor is capable of producing an instantaneous pulse of up to 5 amperes at a voltage rating of about 2.3 volts. Other capacitors may also be used, preferably having an energy density from 1-10 watt-hour/kg.

Power switch SW1 may be activated manually or by a mechanical coupling to a clip attaching the dispenser and to an article of clothing or jewelry so that the power is automatically activated as the device is clipped on.

A microcontroller U1 controls the device operation and starts program execution on power-up. Microcontroller U1 may be, for example, a model PIC12F683 microcontroller available from Microchip Technology, Inc., of Chandler, Ariz., USA. Example microcontroller U1 comprises a microprocessor, volatile and nonvolatile memory, and various input/output capabilities. The microprocessor operates according to program instructions stored in the memory. The main function of microcontroller U1 is to control the time interval between actuation of dispenser 100. The time interval is set based on the diffusivity of the fragrance and the user preference. The device may also be operated manually, using momentary switch SW2. Preferably, microcontroller U1 normally stays in a sleep mode to save power, and wakes on a timer interrupt to disperse fragrance.

A resistor R1 is placed to limit the maximum charge current and the diodes D1 and D2 reduce the charge voltage to keep it within the maximum rating for supercapacitor C1. The thermoelectric transducer is modeled as a resistor R2, and is connected to a power switch transistor Q1, which applies the energy pulse to the thermoelectric transducer R2 under the control of the microcontroller U1.

Preferably, a user input is provided so that the user may control the dispensing time interval. In the example circuit of FIG. 9, potentiometer R4 provides this function. Potentiometer R4 may be conveniently adjusted by a thumb or slide switch on the outside of a dispenser using the circuit of FIG. 9. The voltage from potentiometer R4 is compared with a reference voltage, and microcontroller U1 adjusts the dispensing interval in response to the voltage, according to the program stored in its memory.

In one example embodiment, the component specifications in the circuit of FIG. 9 are as shown in the table below.

| | |
|---|---|
| R1, R3 | 100 Ω |
| R2 | Resistance of thermoelectric transducer |
| R4 | 47 kΩ |
| C1 | 4.7 μF 16 V |
| C2 | Capacitance of supercapacitor, for example 0.18 F (2.3 V) for model GW1 |
| C3, C4, C5, C6 | 0.1 μF 16 V |
| D1, D2 | 1N4148W |
| Q1 | PMV31XN |

Optionally, the circuit may include one or more environmental sensors, and microcontroller U1 may adjust the dispensing of fragrance in reaction to signals provided by the environmental sensors. For example, an accelerometer U2 may supply a signal indicating motion of the dispenser. Accelerometer U2 may be, for example, a model ADXL330 3-axis accelerometer available from Analog Devices, Inc., of Norwood, Mass., USA. Microcontroller U1 may shut off the dispenser, or otherwise reduce its power consumption, when the signal from accelerometer U2 indicates that the dispenser has not moved for a predetermined period of time. For example, if the dispenser has not moved for more than one hour, it may be assumed that the user is not carrying or wearing the dispenser and further dispensing of fragrance would waste the fragrance and consume battery power unnecessarily. Alternatively or in addition, other environmental sensors may be included. For example, a temperature sensor may be provided, and microcontroller U1 may increase the rate of fragrance dispensing as temperature increases, because a fragrance will likely dissipate more quickly at higher temperatures. In another example, a light sensor may be provided, and microcontroller U1 may shut off the dispenser when it is detected that the dispenser has been in near total darkness for a predetermined period of time, on the assumption that the dispenser has been put away for storage and further bursts of fragrance are not needed. Many other scenarios are possible.

Figure 10:
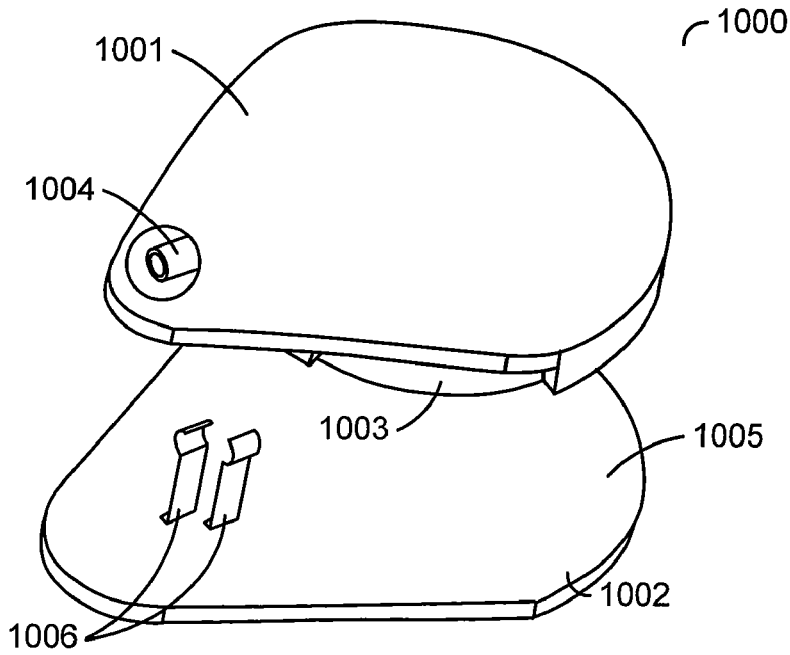
FIG. 10 is a partially exploded top perspective view of a dispenser in accordance with another example embodiment of the invention.
Figure 11:
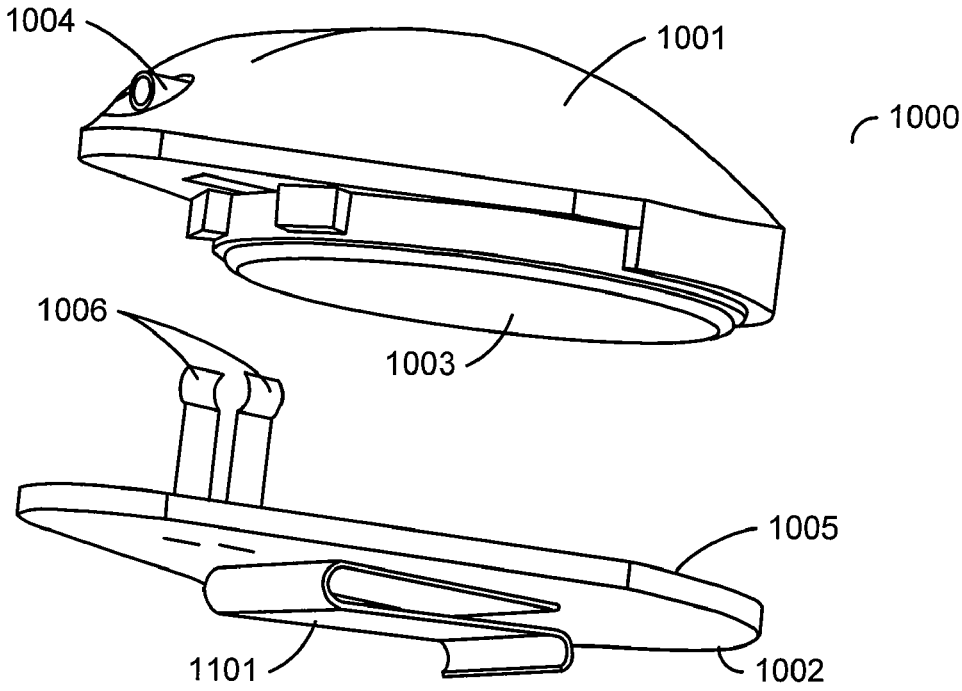
FIG. 11 is a partially exploded bottom perspective view of the dispenser of FIG. 10.

FIGS. 10 and 11 illustrate upper and lower partially exploded perspective views a dispenser 1000 in accordance with another example embodiment of the invention. In this example embodiment, dispenser 1000 comprises a disposable module 1001 and a reusable module 1002. Disposable module 1001 comprises the dispenser components that are consumed by use of the dispenser, namely a battery 1003 and a chamber containing a supply of liquid to be dispensed. The liquid supply is inside the disposable module 1001 and not visible in the figures. Example disposable module 1001 also comprises an annular conduit 1004 through which liquid is dispensed, and a thermoelectric transducer near the outlet end of annular conduit 1004.

Reusable module 1002 comprises a printed circuit board 1005. Printed circuit board 1005 may embody, for example, a circuit like that shown in FIG. 9. When disposable module 1001 and reusable module 1002 are joined, the circuit on printed circuit board 1005 is powered from battery 1003, and contacts 1006 make contact with the thermoelectric transducer. This modular architecture allows a user of the dispenser to replace the liquid and battery, which are both depleted during use of dispenser 1000, without the expense of replacing the electronic control circuit, which is not depleted by use. When assembled, dispenser 1000 may have, for example, an overall length of about 28 millimeters and a width of about 17 millimeters, and may contain up to 1.5 cubic centimeters of a liquid such as a fragrance.

Figure 12:
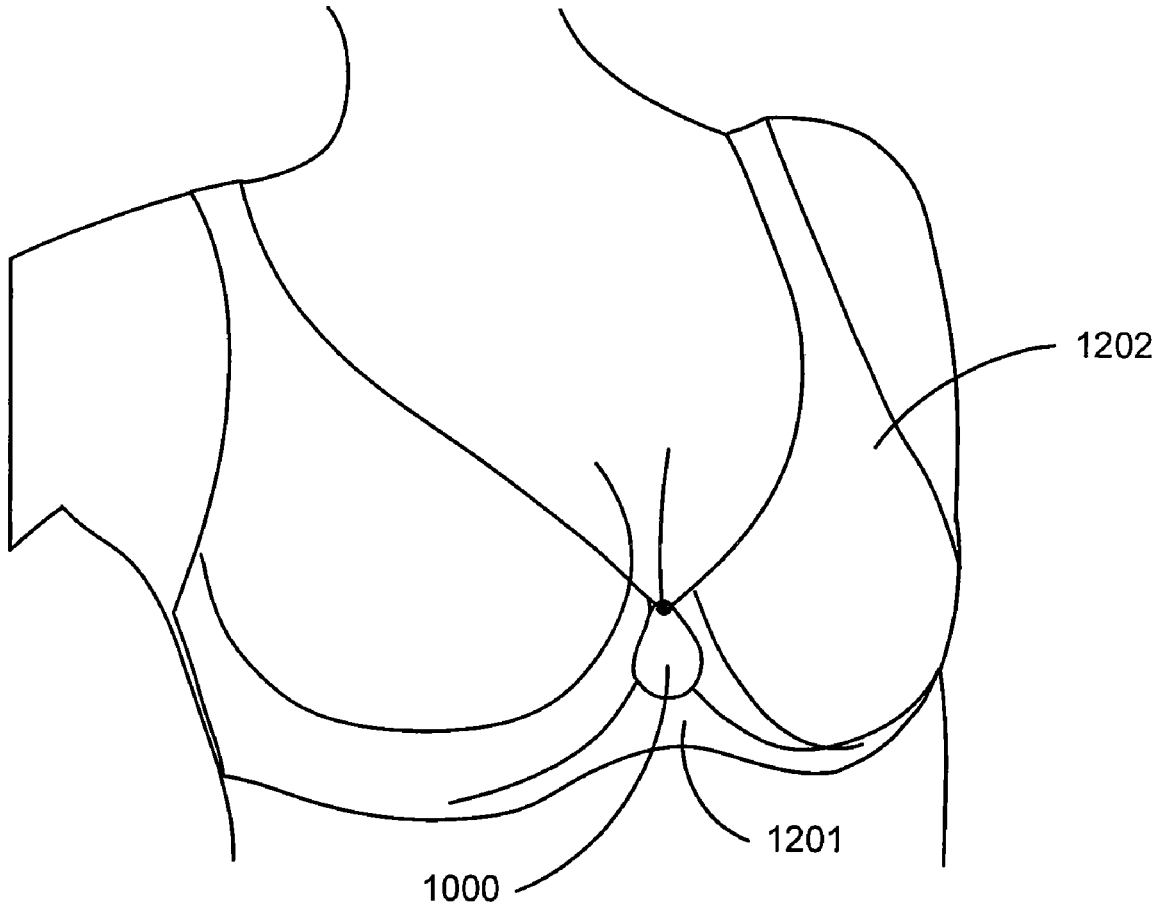
FIG. 12 shows a dispenser being worn on a brassiere, in accordance with an example embodiment of the invention.

As is best seen in FIG. 11, dispenser 1000 may also comprise a clip 1101, allowing dispenser 1000 to be attached to an article of clothing or jewelry, for example. FIG. 12 shows dispenser 1000 clipped to the band 1201 of a brassiere 1202. Dispenser 1000 may be attached to other clothing or jewelry articles as well.

In another aspect, a dispenser in accordance with an example embodiment of the invention may have more than one supply of liquid and more than one annular conduit, forming more than one dispensing system. In one example use, each dispensing system contains a supply of liquid and the liquids may be different from each other. The liquids may be dispensed independently under control of an electronic circuit. For example, if the liquids are fragrances, one that is more volatile and dissipates more rapidly may be dispensed more often than another that is less volatile, or one that is less intense may be dispensed more often than one that is more intense.

Figure 13:
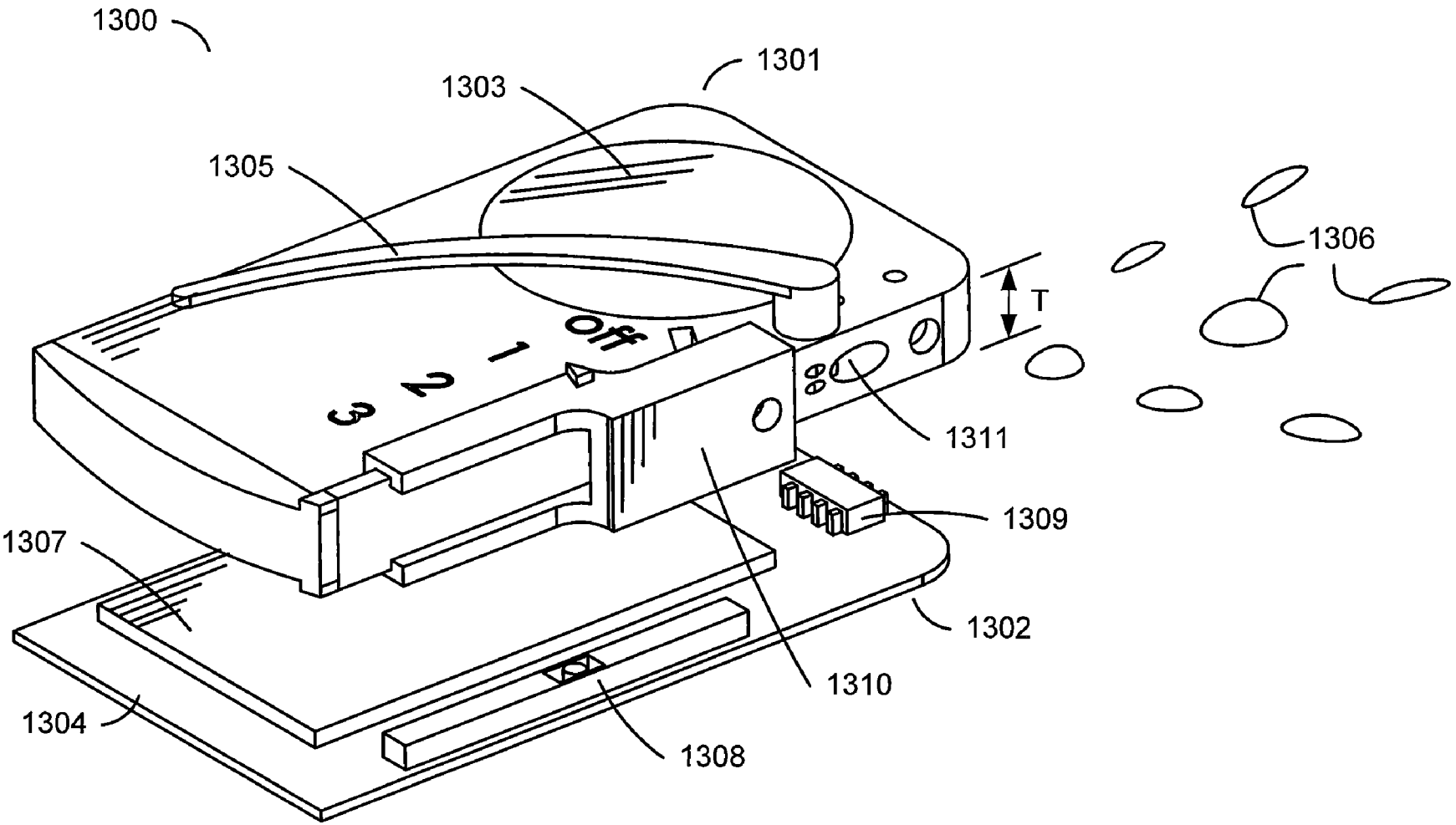
FIG. 13 is a partially exploded perspective view of a dispenser in accordance with another example embodiment of the invention.

FIG. 13 is a partially exploded perspective view of a dispenser 1300 in accordance with another example embodiment of the invention. Dispenser 1300 also comprises a disposable module 1301 and a reusable module 1302. Disposable module 1301 comprises the components of dispenser 1300 that are depleted by use, namely a battery in compartment 1303, as well as a supply of liquid to be dispensed (inside module 1301 and not visible in FIG. 13). Reusable module 1302 comprises a printed circuit board 1304, which embodies an electronic control circuit, such as the circuit shown in FIG. 9. Dispenser 1300 also comprises a clip 1305, which enables dispenser 1300 to be attached under the edge of a shirt neckline and positioned to eject perfume particles 1306 from the neckline toward the chest or neck of the person wearing the device. (Of course, dispenser may be attached to other articles of clothing or jewelry as well.) Accordingly, example dispenser 1300 has a flat and thin shape. In the example embodiment shown, dispenser 1300 has a thickness T of about 5 millimeters, sufficiently thin that dispenser 1300 can be placed under a neckline almost unnoticeably. The example device has a generally rectangular shape, with a length of about 30 millimeters and a width of about 18 millimeters, and a weight of less than 4 grams when filled with perfume. In other embodiments, the device may have a circular, oval, or other shape. Preferably, the thickness T is not greater than about 6 millimeters.

Example reusable module 1301 comprises printed circuit board 1304, including a supercapacitor 1307, a sliding timer switch 1308 and other electronic components 1309, which may conform to the circuit described in FIG. 9. The reusable module 1302 and the disposable module 1301 are configured to be attached to form a complete assembly or easily detached to replace the reusable cartridge 1301 with a new one. Supercapacitor 1307 may be, for example, a prismatic supercapacitor model GW1 or HW1 made by CAP-XX Ltd. of Lane Cove, Australia.

A sliding control 1310 enables a user to provide input to dispenser 1300, so that the user may specify certain operating parameters. Sliding control 1310 actuates sliding timer switch 1308, which may correspond, for example, to potentiometer R4 in the circuit of FIG. 9. Sliding control 1310 may be slid between the "OFF" position and any of the three "ON" positions "1", "2" or "3". Each position provides a different preset time interval between actuations. When reusable module 1302, including printed circuit board 1304, is attached to disposable module 1301, sliding control 1310 is mechanically engaged with sliding timer switch 1308 on the printed circuit board 1304 such that switch 1308 follows the sliding movement of control 1310. When sliding control 1310 is in the "OFF" position, control 1310 seals off the opening 1311 of the dispensing nozzle. This arrangement prevents evaporation of volatile perfume solution during periods of non-use.

Figure 14:
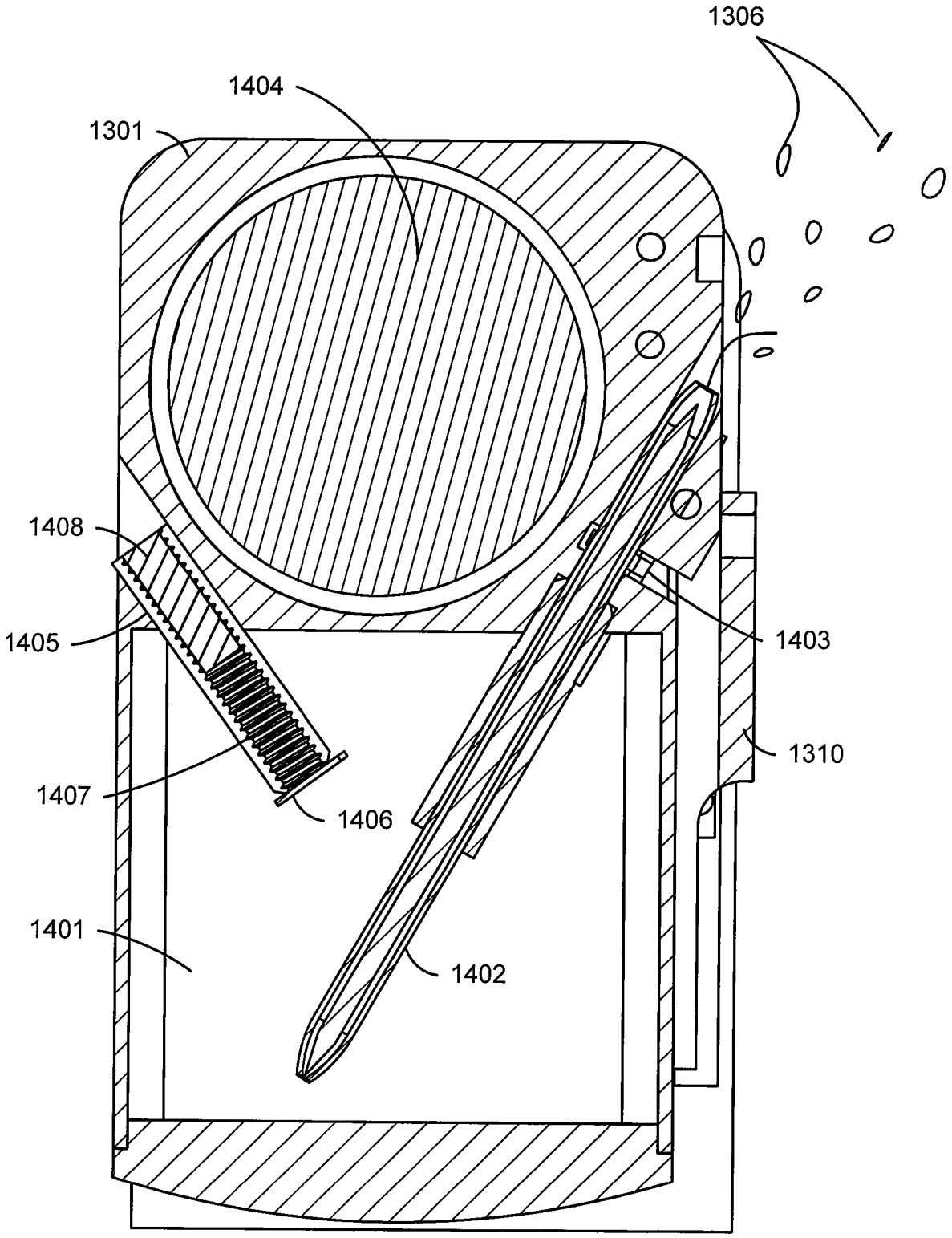
FIG. 14 is a cross sectional view showing internal structure of the dispenser of FIG. 13.

FIG. 14 is a cross sectional view showing internal structure of the dispenser of FIG. 13. As illustrated, the disposable module 1301 comprises a housing defining a chamber 1401 for storing a liquid such as a perfume to be dispensed. Disposable module 1301 also comprises a thin-walled annular capillary conduit 1402 extending from the chamber 1401 and defining an outlet passage. One end of annular conduit 1402 is submerged in the supply of liquid to be dispensed. A thermoelectric transducer 1403 is attached on the external surface of the annular capillary conduit 1402 and is configured to produce heat energy which causes liquid/vapor phase transition within the annular capillary conduit 1402 when electrical current is applied to thermoelectric transducer 1403. Expansion of the liquid in annular conduit 1402 ejects liquid as a dispersion of droplets 1306 upon each thermal actuation. A battery 1404 is seated in a round cavity of the disposable module 1301. Battery 1404 may be, for example, a model 1632 button cell available from the Procter and Gamble Company of Cincinnati, Ohio. USA. This kind of battery has an energy capacity of about 1300 joules, which is sufficient to dispense the volume of 1 milliliter of perfume stored within the chamber 1401. Conveniently, disposable module 1301 may be disposed of with the battery. Optionally the battery may be removed and disposed of separately to comply with government battery disposal guidance.

The disposable module 1301 and particularly any portion that is in contact with any perfume solution are preferably made of a material that is compatible with volatile oils and solvents. Suitable materials include, without limitation, polyethylene terephthalate (PET), polybutylene terephthalate (PBT), polypropylene, or high density polyethylene (HDPE). At least some surfaces of disposable module 1301 are preferably coated with a thin layer of glass-like material such as silicon oxide ($SiO_2$) or titanium oxide ($TiO_2$). A thin coating with a thickness of about 100 Å may be deposited by the process of plasma impulse chemical vapor deposition (PICVD). The coating prevents leaching of certain chemicals from the plastic into any perfume solution.

Alternatively the dispensing apparatus may be made from glass or ceramic. For safety purposes the glass may be coated with thin plastic film, about 25 microns thick, which could prevent injury in the event of breakage.

Example disposable module 1301 is provided with air venting port 1405, which equalizes the pressure inside the chamber 1401 with the atmospheric pressure, and allows air to replace liquid in chamber 1401 as the liquid is dispensed. Venting port 1405 is provided with a membrane 1406 that is permeable to air but impermeable to volatile solvents such as ethanol. Thus, venting port 1405 is configured to allow a small inflow of air into the chamber and to prevent outflow of liquids and vapor from the chamber.

Example venting port 1405 comprises a long spiral channel formed between a spiral thread 1407 and a pin 1408. One end of the venting port 1405 is in fluid communication with the liquid in chamber 1401, and the second is open to the atmosphere. The first opening is sealed with a membrane 1406. Membrane 1406 allows the flow of air from the ambient atmosphere into chamber 1401 but does not allow flow of liquid solution from chamber 1401 into venting port 1405. However, the membrane may not prevent diffusion of vapors from chamber 1401 to the atmosphere. Since diffusion through a passage is inversely proportional to the length of the passage, a long spiral channel is provided as a venting passage between the atmosphere and the chamber. The spiral channel readily minimizes vapor diffusion without significantly affecting the overall size of the device.

Membrane is 1406 is preferably permeable to air but impermeable to volatile solvents such as ethanol and triethylene glycol (TEG) which are often used in perfume solutions. Membrane 1406 may be made, for example, of a super hydrophobic material such as unsaturated polyester (UPE) or polytetrafluoroethylene (PTFE) chemically modified to produce oleo phobic properties. In one example embodiment, membrane 1406 is made of a material commercially known as SurVent, and manufactured by Millipore Corporation, of Billerica, Mass., USA. Other comparable membrane materials made by W.L. Gore and Associates, Inc, of Newark, Del., USA. Membrane 1406 may be connected to the venting port 1405 by, for example, ultrasonic welding, radio frequency (RF) welding, by heat sealing, or by any other suitable method.

Figure 15A:
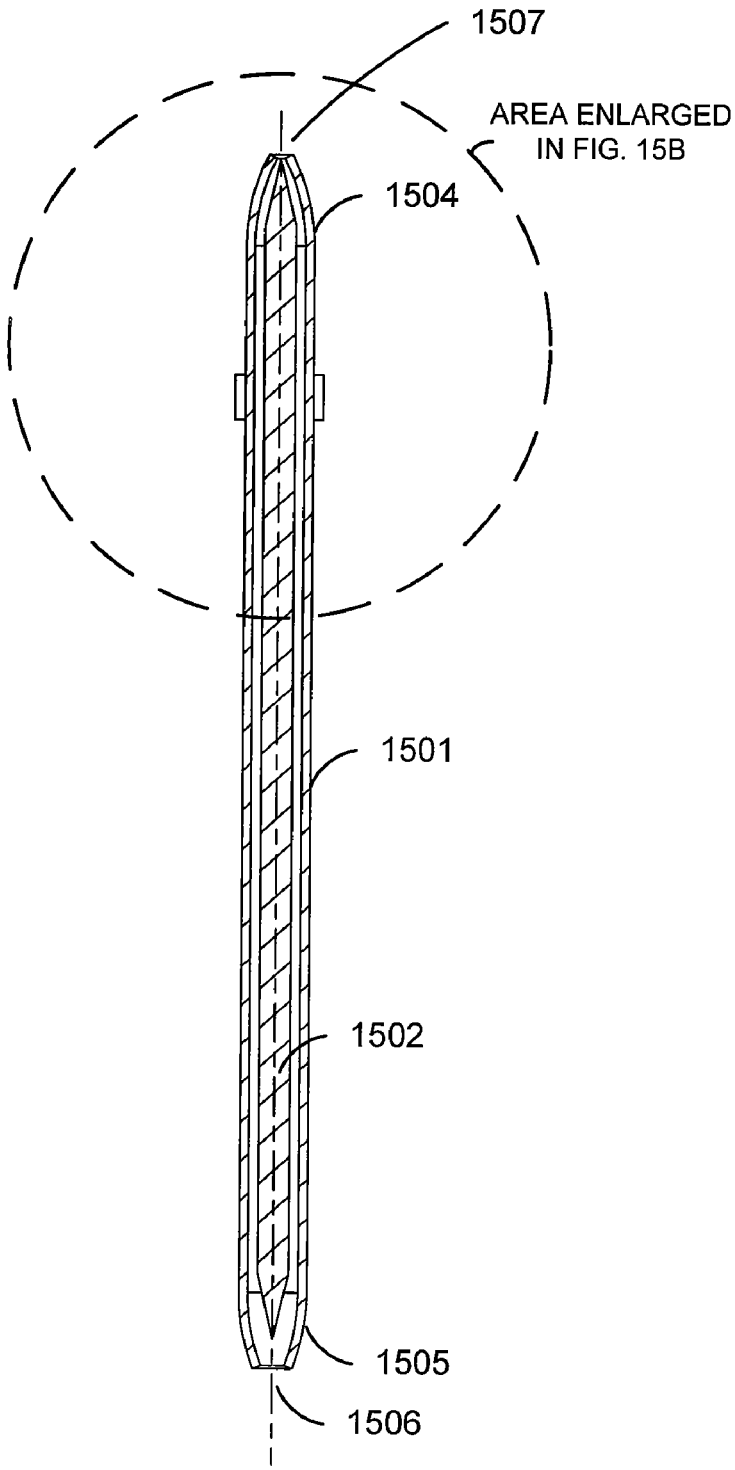
FIG. 15A is a longitudinal cross sectional view of an annular conduit, in accordance with an example embodiment of the invention.
Figure 15B:
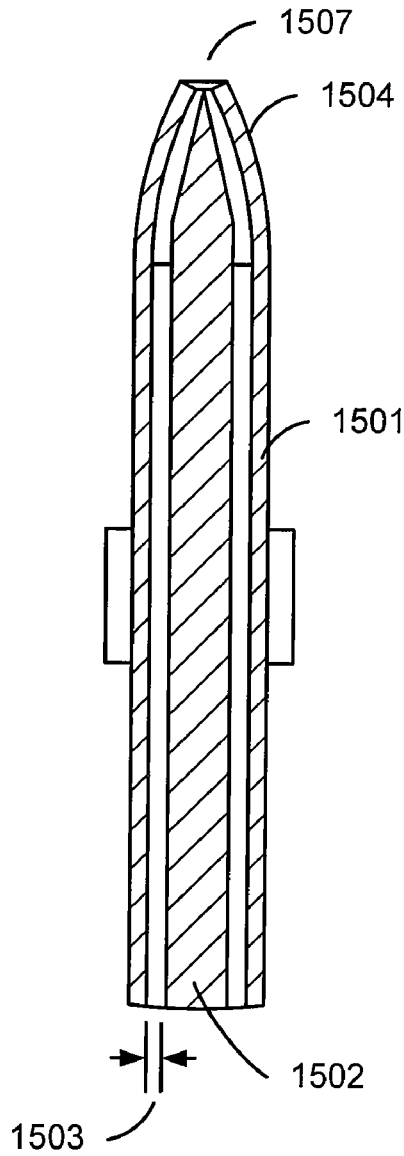
FIG. 15B is an enlarged detail view of a portion the annular conduit of FIG. 15A.

FIGS. 15A and 15B show a longitudinal cross sectional view and an enlarged detail view of example annular capillary conduit 1402. Annular capillary conduit 1402 comprises of two concentric cylindrical members. The first member is an external tubular member 1501 and the second is an internal core member 1502. In one example embodiment, core member 1502 has an outside diameter approximately 0.1 mm smaller than the internal diameter of tubular member 1501. Thus, in this example, when the core member is inserted inside the tubular member there is a radial gap 1503 of nominally 0.050 mm formed between the internal and the external members. The annular gap 1503 defines a capillary channel which is capable of drawing large volume of liquid when compared to simple cylindrical capillary tube. In this example embodiment, the capillary pressure is about 500 Pascal, drawing a volume of 38 cubic mm when liquid perfume is used.

In this example embodiment, the volume of liquid dispensed upon each actuation is about 1-5 microliters. If it is desired to change the volume dispensed with each actuation, the mean diameter of the annular channel may be scaled up or down to increase or decrease the volume of liquid to be dispensed. The annular gap may remain substantially the same such that the capillarity is unaffected. While external tubular member 1501 and core member 1502 are shown in FIGS. 15A and 15B as circular cylinders, other shapes may be used as well. For example, external tubular member 1501 and core member 1502 may be oval or rectangular in cross section, or have any other suitable shape. Preferably, external tubular member 1501 and core member 1502 are made of glass, non-limiting examples of which include borosilicate glass, ceramic glass, mica ceramic glass, soda lime and quartz.

In one example method of making annular conduit 1402, core member 1501 is inserted inside tubular member 1501. The ends 1504 and 1505 of tubular element 1501 are deformed inwardly to capture the core member 1502 within the tubular member 1501. The tubular member is deformed when subjected to high temperature, a process that is well known to those who are skilled in the art of glass work. In one example embodiment, the inlet orifice 1506 has a diameter of about 0.1 mm and the outlet orifice 1507 has a diameter from 0.1 mm to 0.8 mm.

Figures 16A, 16B:
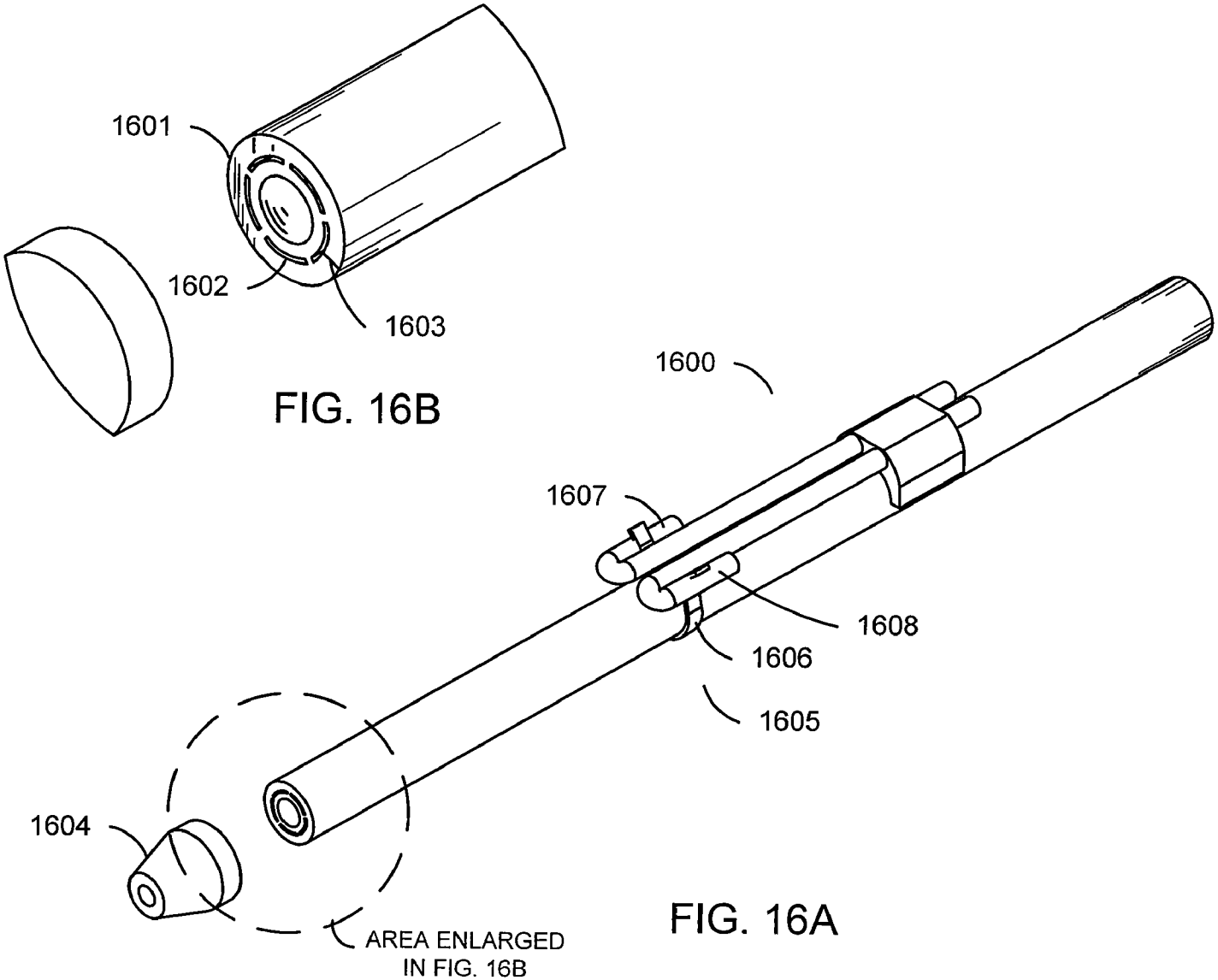
FIG. 16A is a perspective view of an extruded annular conduit in accordance with an example embodiment of the invention.
FIG. 16B is an enlarged detail view of a portion of the extruded annular conduit of FIG. 16A.

In another example method of making annular conduit 1501, conduit 1501 may be formed by the manufacturing process of material extrusion. In extrusion, a long hollow body of a fixed cross-section profile is formed. FIGS. 16A and 16B show a perspective view and an enlarged detail view of an annular conduit 1600 that is formed by glass extrusion. The cross sectional view of the profile is shown in the detail view of FIG. 16B. The profile is defined by a circle 1601 and an array of arc-shape annular openings 1601 arranged concentrically with circle 1601. In this example, there are five arc-shaped openings, but other numbers may be used. In one example embodiment, the distance 1603 between the circumference of the circle 1601 and the arc-shaped annular openings 1602 is about 0.1 mm to 0.3 mm. The length of each arc-shaped opening is preferably less than 2 millimeters and its width is from 0.050 to 0.2 millimeters. FIG. 16A illustrates the extruded capillary conduit 1600 and an output nozzle 1604 that may be optionally connected to the end of the conduit 1600.

Also shown in FIG. 16A is a thermoelectric transducer 1605 in accordance with another example embodiment of the invention. In this example embodiment, thermoelectric transducer 1605 comprises a high resistance ribbon 1606 wound around the external surface of capillary conduit 1600. The ribbon generates thermal energy by a process of ohmic or joule heating in which the passage of electric current releases heat energy. The heat is transferred from the face of the ribbon through the external face of conduit 1600 and into the liquid to cause instantaneous nucleus boiling and vapor expansion. As compared with a round wire, a ribbon has the advantage that it has a larger surface area in contact with the tubular member and a resultant increase in the rate of heat transfer into the tubular member. A higher rate of heat transfer results in lower operating temperature of the ribbon which in turn reduces energy losses due to thermal radiation. In one example embodiment, the total electrical resistance of ribbon 1606 is about 0.9Ωand ribbon 1606 has a width of about 0.2 mm. In the example of FIG. 16A, ribbon 1606 is connected to two electrodes 1607 and 1608, and may be secured by, for example, resistance welding, a mechanical tapered locking feature, or other suitable means. Electrodes 1607 and 1608 define two terminals through which a source of voltage is connected. In one example embodiment, the operating voltage is less than 3 volts, and is more preferably about 2.75 volts.

Figure 17:
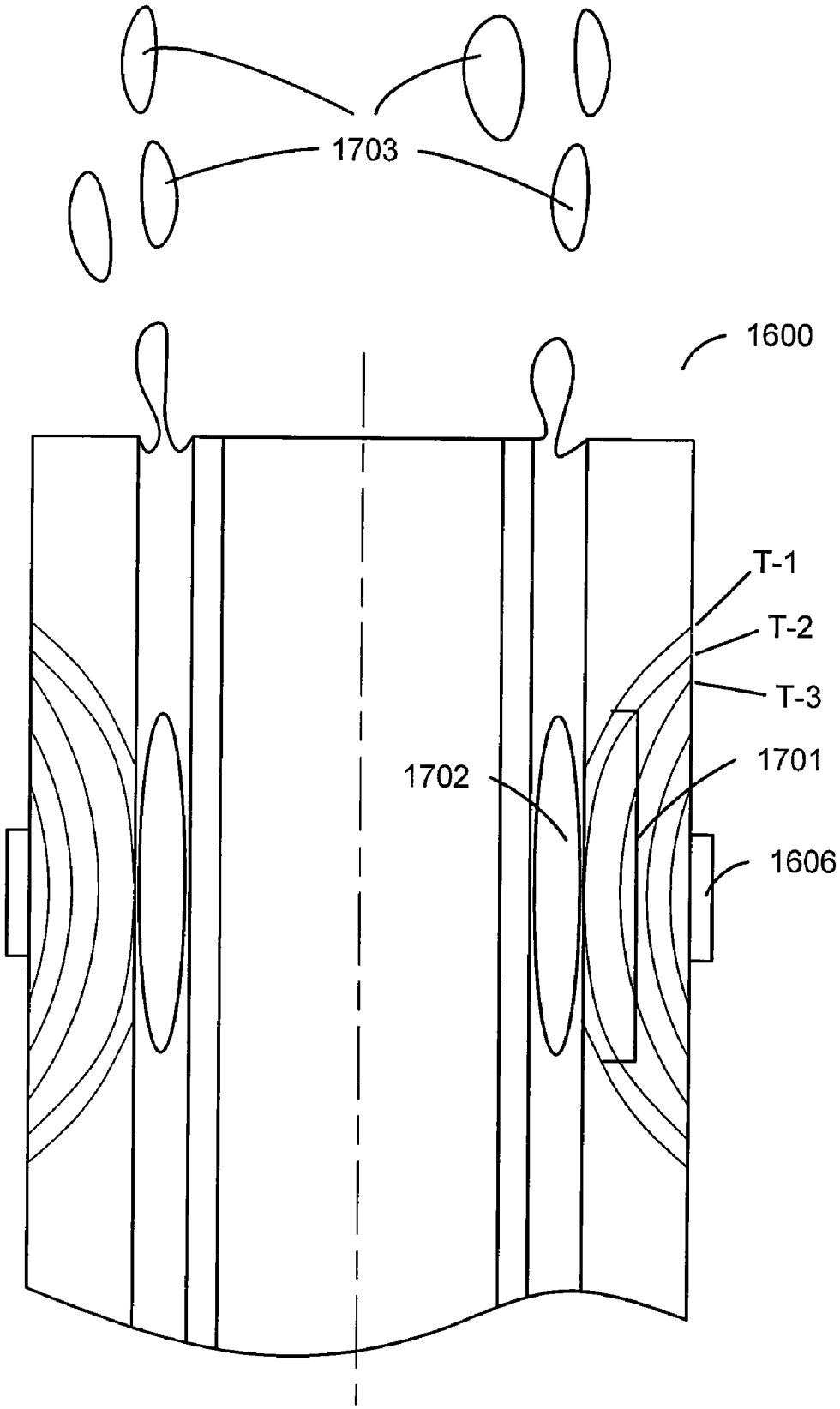
FIG. 17 is a cross sectional view of an annular conduit in accordance with an example embodiment of the invention, showing an approximate temperature distribution within the annular conduit.

FIG. 17 is a cross sectional view of an annular conduit in accordance with an example embodiment of the invention, showing an approximate temperature distribution within the annular conduit. The lines T-1, T-2 and T-3 represent isothermal contour lines, and approximate contours that may be obtained by numerical computation. In this example embodiment, the temperature at line T-3 is, for example, 230° C., the temperature at line T-2 is 190° C., and the temperature at line T-1 is 150° C. The isothermal lines show that heat is spread from the thermoelectric element 1606 to a larger area 1701. As a result bubble 1702 that is generated near the area 1701 is of a relatively large size as compared with the size of thermoelectric element 1606. Thus, the method to transfer the heat from thermoelectric element 1606 through a solid member produces a large bubble 1702 and a strong pulse of liquid droplets 1703.

Moreover, this arrangement further reduces the power requirement. The wall of the tubular member 1600 operates as a heat sink to absorb and store the energy from the thermoelectric transducer 1605 such that heat energy can be transferred at a slow rate, which in turn requires smaller power source. To minimize the energy losses due to heat dissipation, the tubular member 1600 is preferably made of a material that has low thermal conductivity. Examples of suitable materials include glass, ceramic, and Pyrex.

In some embodiments, the thermoelectric transducer 1605 receives energy from a double-layer supercapacitor, such as supercapacitor 1307 shown in FIG. 13. Supercapacitor 1307 may be, for example, a model GW1 or HW1 supercapacitor available from CAP-XX Ltd., of Lane Cove Australia. Each of these models has footprint of about 28.5×17.0 millimeters and a thickness of about 1.2 millimeters. The preferred capacitance is from 0.18 Farad to 1 Farad and more preferably from 0.6 Farad to 1 Farad. Supercapacitor model HW1 has a nominal voltage of 2.75 volts, which is suitable for receiving energy from most standard 3 volt coin or button cell batteries.

If supercapacitor 1307 is discharged all at once through the resistive thermoelectric transducer 1605, for example by simply switching on transistor Q1 in the circuit of FIG. 9, the power imparted to transducer 1605 decays according to an exponential profile typical of resistor-capacitor (RC) circuits. Such a discharge curve is shown in exponential curve 1801 in FIG. 18. Curve 1801 follows the relation $V=V_0(1-e)^{t/RC}$ ($V_0$=initial capacitor voltage; t=time; R=resistance of the transducer; C=capacitance of the supercapacitor). Accordingly, the heat generation in thermoelectric transducer 1605 follows a similar profile. That is, heat is generated at a faster rate at the beginning of the discharge, when capacitor 1307 is still nearly fully charged, than near the end when capacitor 1307 is nearly depleted. Because the tubular member of annular conduit 1600 is not perfectly thermally conductive, it is limited in its ability to conduct the heat to the fluid. As a result, when energy is supplied to transducer 1605 at a very high rate, transducer 1605 may increase in temperature and lose significant energy by radiation of heat away from conduit 1600. Heat lost by radiation does not contribute to the boiling of fluid in the conduit, and the energy used to generate that heat is therefore wasted.

In a dispenser according to one embodiment of the invention, the supply of energy to transducer 1605 is controlled so that the discharge of energy to transducer 1605 is spread more evenly throughout a discharge cycle. This may be accomplished using pulse width modulation, as is shown schematically in the lower trace 1802 of FIG. 18. In this scheme, the thermoelectric element is switched "on", for example by switching on transistor Q1 in the circuit of FIG. 9, for a very short time t1 at the beginning of discharge when the capacitor is fully charged. The thermoelectric element is then switched "off". After an interval T has elapsed, the thermoelectric element is switched "on" again for a time t2, which is slightly longer than t1. The thermoelectric element is then switched "off" again. Upon successive intervals T, the process is repeated, using progressively longer "on" times t3, t4, etc. Because the capacitor is charged to a slightly lower voltage with each successive interval, power flows to the thermoelectric element slightly more slowly with each "on" cycle, and a slightly longer "on" cycle is needed to impart roughly the same amount of energy to the thermoelectric element. This scheme has the effect of controlling the rate of heat transfer to the liquid in annular conduit 1600 in relation to the charge level of supercapacitor 1307. In one embodiment, the pulse widths t1, t2, t3, etc. may be selected to impart roughly equal amounts of energy to the thermoelectric element in each "on" period. Advantageously, the transducer temperature is minimized to prevent energy loss by heat radiation.

Figure 18:
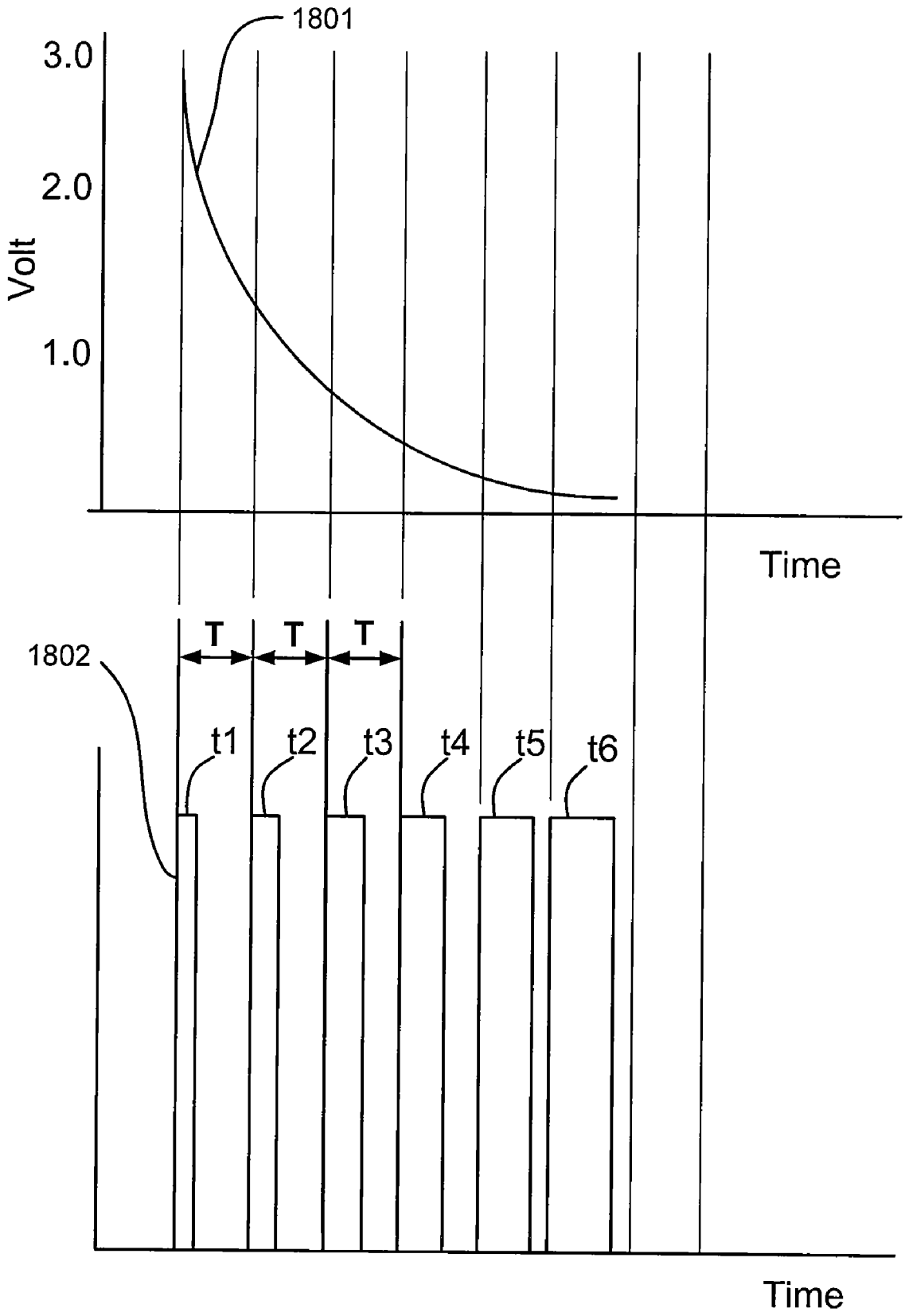
FIG. 18 shows a schematic representation of the operation of a pulse width modulated control system, in accordance with an example embodiment of the invention.

Note that the total elapsed time shown in FIG. 18 is the time elapsed during one actuation of the dispenser providing one pulse of liquid, and may be only a few milliseconds or less. After the events shown in FIG. 18 are completed, the circuit may stay in the "off" state for several minutes or longer while the supercapacitor is recharged in anticipation of the next dispensing cycle.

In other embodiments, the duty cycle may be altered to create various energy transfer profiles. Advantageously, the energy transfer produces a temperature profile that is about 150° C. to 250° C. greater than the fluid/vapor transition temperature.

In accordance with another example embodiment of the invention, a dispenser may operate directly by a single alkaline battery type AAA or type AAAA, without a super-capacitor circuit. The transfer of heat from the thermoelectric element to the wall of the tubular member may take 0.1 second to 1 seconds at a power input rate of about 0.5-1 watt. Significant heat energy of about 0.05-1 joules is transferred to the liquid and produces a large bubble which drives a large pulse flow of particles from the opening. This characteristic makes the present invention suitable to dispense personal care products as a pulse of spray and particularly useful for a portable miniature pocket-size package of personal care products such as deodorants, cologne, eye care products etc. Such device can readily use AAAA battery operable by a momentary mechanical switch and optionally has an array of capillary conduits to increase the amount of liquid spray upon each actuation. The spray nozzle of the present invention comprises low cost assembly and ejects relatively large particles when compared to a solid-state inkjet micro fluidic circuit.

A super capacitor charging circuit similar to that shown in FIG. 9 may also be used to drive a solid state inkjet circuit providing that the thermoelectric transducer in the circuit is adapted to work with a low voltage source of the supercapacitor, which is typically less than 3 volts. Specifically the transducer resistance value should be is less than 10 ohm and more preferably less than 5 ohm and most preferably less than 2 ohm.

A common element in the embodiments shown is a thermoelectric transducer placed about the external surface of a tube or other solid member which separates the liquid from the thermoelectric element such that the solid element sinks and transfers the heat energy to the liquid. This method has been surprisingly effective in producing a strong flow of particles and is particularly useful when a relatively long time interval between pulses of flow is affordable.

While dispensers according to embodiments of the invention may be used to dispense a wide variety of fluids, the system is especially well adapted to dispensing of fragrances or perfumes, especially those formulated with denatured alcohol, ethanol, triethylene glycol (TEG) and fragrance oils. Triethylene glycol may be added to reduce the volatility of the perfume solution to minimize evaporation through the capillary conduit. Fragrances with high concentrations of aromatic compounds allow use of smaller quantities of liquid, and may allow use of a smaller and less obtrusive dispenser.

The fluids that are most suitable to produce strong capillarity have a surface tension between 20 to 35 dyne per centimeter and a viscosity of less than 4 centipoises. The surface angle that is formed between the glass conduit and the perfume is preferably less than 30 degrees to enhance the capillarity. In some cases a small amount of fluorosurfactant may advantageously be added to further reduce the surface tension.

A dispenser according to an embodiment of the invention can be used to forcefully dispense droplets of liquid over an extended period of time with the advantage of having very small size and particularly a very small energy source.

While the present invention has been described with respect to what is presently considered to be the preferred embodiment, it is to be understood that the invention is not to be limited to the disclosed embodiments or to a particular type of liquid. To the contrary, the invention defines a new and innovative micro-spray dispensing platform that is intended to cover various modifications and equivalent arrangement within the spirit and the scope of the appended claims.

What is claimed is:

1. A dispenser for dispensing a liquid, the dispenser comprising:

a chamber holding a supply of liquid to be dispensed;

an annular conduit having a first end and a second end, the first end submerged in the supply of liquid and the second end extending outside the chamber, liquid from the supply substantially filling the conduit; and a thermoelectric transducer proximate the second end of the annular conduit;

wherein, upon application of electrical current to the thermoelectric transducer, the thermoelectric transducer operates to cause boiling of a quantity of liquid in the annular conduit, the boiling generating a bubble, the expansion of which bubble forces liquid out the second end of the annular conduit.

2. The dispenser of claim 1, wherein the thermoelectric transducer comprises a resistive electrical wire or ribbon wound around the annular conduit.

3. The dispenser of claim 1, wherein the thermoelectric transducer comprises a resistive layer deposited on an outer surface of the annular conduit.

4. The dispenser of claim 1, further comprising:

an electronic circuit controlling the supply of energy to the thermoelectric transducer; and a battery supplying energy to operate the electronic circuit and supplying energy to the thermoelectric transducer under control of the electronic circuit.

5. The dispenser of claim 1, wherein the electronic circuit comprises a supercapacitor, and the electronic circuit operates to periodically:

charge the supercapacitor using energy from the battery; and discharge the supercapacitor through the thermoelectric transducer, thereby supplying a pulse of energy to the thermoelectric transducer and dispensing a quantity of liquid.

6. The dispenser of claim 5, wherein the supercapacitor has an energy density of 0.5 to 10 watt hour/kg.

7. The dispenser of claim 1, further comprising an environmental sensor selected from the group consisting of an accelerometer, a temperature sensor, and a light sensor, and wherein environmental sensor supplies a signal to the electronic circuit, which adjusts the operation of the dispenser in reaction to the signal.

8. The dispenser of claim 7, wherein the environmental sensor is an accelerometer, and wherein the electronic circuit reduces power consumption of the dispenser when the signal from the accelerometer indicates that the dispenser has not been moved for a predetermined period of time.

9. The dispenser of claim 1, wherein the electronic circuit controls the dispenser to dispense liquid in periodic pulses, and wherein the period between pulses is adjustable by a user of the dispenser.

10. The dispenser of claim 1, further comprising:

a venting port that admits air to the chamber as liquid is dispensed; and a membrane sealing the venting port, wherein the membrane is permeable to air but impermeable to volatile solvents.

11. The dispenser of claim 1, further comprising a venting port that admits air to the chamber, and wherein the venting port comprises a helical channel through which the air is admitted.

12. The dispenser of claim 1, farther comprising, proximate the second end of the annular conduit, a normally-closed valve configured to prevent passage of the liquid from the annular conduit when the thermoelectric transducer is idle.

13. The dispenser of claim 1, wherein liquid from the supply is drawn into the annular conduit by capillary action.

14. The dispenser of claim 1, wherein the liquid is a fragrance or other personal care liquid.

15. The dispenser of claim 1, farther comprising means for attaching the dispenser to an article of clothing or jewelry, rendering the dispenser wearable.

16. The dispenser of claim 1, further comprising one or more additional annular conduits and supplies of liquid to be dispensed, and wherein the supplies of liquid are dispensed independently of each other under control of an electronic circuit.

17. The dispenser of claim 1, wherein the liquid is dispensed in a spray of droplets upon each actuation, and wherein each actuation sprays at least one microliter of liquid.

18. The dispenser of claim 1, wherein the conduit has a thermal conductivity of 0.5 to 2.0 watt/m K.

19. A dispenser for dispensing a liquid, the dispenser comprising:

a disposable module comprising a chamber containing a supply of liquid to be dispensed, a coin cell battery, an annular conduit having a first end submerged in the supply of liquid and a second end protruding from the chamber, and a thermoelectric transducer proximate the second end of the annular conduit and configured to cause boiling of an amount of liquid in the annular conduit upon the application of electrical current to the thermoelectric transducer, and wherein the boiling forces droplets of liquid out the second end of the annular conduit;

a reusable module comprising an electronic control circuit that controls operation of the dispenser; and an interface between the disposable module and the reusable module, the interface attaching the two modules mechanically, making an electrical connection between he coin cell battery and the electronic control circuit, and making an electrical connection between the electronic control circuit and the thermoelectric transducer.

20. the dispenser of claim 19, wherein the dispenser is wearable.

21. The dispenser of claim 19, wherein the liquid is a fragrance.

22. The dispenser of claim 19, wherein the electronic control circuit comprises a supercapacitor, and wherein the electronic control circuit operates to periodically charge the supercapacitor from the battery and discharge the supercapacitor though the thermoelectric transducer, thereby supplying a pulse of energy to the thermoelectric transducer and dispensing a quantity of liquid.

23. The dispenser of claim 19, further comprising:

a user control having an off position and at least one on position; and an opening in the second end of the annular conduit through which opening liquid is dispensed;

and wherein, when the user control is in the off position, the user control covers the opening.

24. A dispenser for dispensing a liquid, the dispenser comprising:

a chamber holding a supply of liquid to be dispensed;

a capillary conduit drawing liquid from the from the supply;

a thermoelectric transducer proximate an end of the capillary conduit;

a miniature battery;

a supercapacitor; and an electronic control circuit configured to charge the supercapacitor from the battery and discharge the supercapacitor through the thermoelectric transducer, thereby causing ejection of liquid from the end of the capillary conduit.

25. The dispenser of claim 24 wherein the capillary conduit has an outer surface that is a circular cylinder for at least a portion of its length.

26. The dispenser of claim 24 wherein the capillary conduit has an outer surface that is generally rectangular in cross section.

* * * * *

UNITED STATES PATENT AND TRADEMARK OFFICE

CERTIFICATE OF CORRECTION

PATENT NO. : 7,673,820 B2
APPLICATION NO. : 11/938500
DATED : March 9, 2010
INVENTOR(S) : Ivri et al.

It is certified that error appears in the above-identified patent and that said Letters Patent is hereby corrected as shown below:

At Column 16, line 15, delete "farther" and insert --further-- therefor.

At Column 16, line 23, delete "farther" and insert --further-- therefor.

At Column 16, line 57, delete "the" and insert --The-- therefor.

At Column 16, line 65, delete "though" and insert --through-- therefor.

Signed and Sealed this

Thirteenth Day of April, 2010

David J. Kappos

David J. Kappos
*Director of the United States Patent and Trademark Office*